US005808412A

United States Patent [19]

Zovko et al.

[11] Patent Number: 5,808,412

[45] Date of Patent: Sep. 15, 1998

[54] EL PANEL LAMINATED TO REAR ELECTRODE

[75] Inventors: Charles I. Zovko, Chandler; Walter J. Paciorek, Phoenix; Edward L. Kinnally, Gilbert; Van H. Potter, Scottsdale, all of Ariz.

[73] Assignee: Durel Croporation, Chandler, Ariz.

[21] Appl. No.: 694,314

[22] Filed: Aug. 8, 1996

[51] Int. Cl.[6] ..... H01J 1/62; H01J 63/04

[52] U.S. Cl. ..... 313/509; 313/506; 313/505; 313/511

[58] Field of Search ..... 313/498, 500, 313/502, 503, 505, 506, 507, 509, 510, 511, 512

[56] References Cited

U.S. PATENT DOCUMENTS

| | | | |
|---|---|---|---|
| 4,020,389 | 4/1977 | Dickson et al. | 313/509 X |
| 4,104,555 | 8/1978 | Fleming | 313/512 |
| 4,560,902 | 12/1985 | Kardon | 313/502 |
| 4,684,353 | 8/1987 | deSouza | 445/51 |
| 4,769,753 | 9/1988 | Knudson et al. | 363/60 |
| 4,839,558 | 6/1989 | Mierzwinski | 313/510 |
| 5,276,382 | 1/1994 | Stocker et al. | 313/506 |
| 5,309,060 | 5/1994 | Sharpless et al. | 313/511 |
| 5,332,946 | 7/1994 | Eckersley et al. | 313/506 |
| 5,469,019 | 11/1995 | Mori | 313/509 |
| 5,565,733 | 10/1996 | Krafrik et al. | 313/510 |
| 5,672,937 | 9/1997 | Choi et al. | 313/503 |
| 5,686,792 | 11/1997 | Ensign, Jr. | 313/510 X |

*Primary Examiner*—Sandra L. O'Shea
*Assistant Examiner*—Mack Haynes
*Attorney, Agent, or Firm*—Paul F. Wille

[57] ABSTRACT

An EL panel includes lamp materials laminated to a conductive sheet, wherein the lamp materials include a front electrode, a phosphor layer, and a dielectric layer. The conductive sheet is the rear electrode for the EL panel. In accordance with one aspect of the invention, the conductive sheet is metal foil, a layer of a printed circuit board, or a layer on a flex circuit. In accordance with another aspect of the invention, the phosphor layer and the dielectric layer are applied to the front electrode by screen printing or by roll coating.

5 Claims, 2 Drawing Sheets

EL PANEL LAMINATED TO REAR ELECTRODE

BACKGROUND

This invention relates to electroluminescent (EL) panels and, in particular, to an EL panel in which the rear electrode is a metal sheet, a printed circuit board, or a flex circuit and the remainder of the lamp is laminated to the rear electrode. As used herein, an EL "panel" is a single sheet including one or more luminous areas, wherein each luminous area is an EL "lamp."

An EL lamp is essentially a capacitor having a dielectric layer between two conductive electrodes, one of which is transparent. The dielectric layer includes a phosphor powder or there is a separate layer of phosphor powder adjacent the dielectric layer. The phosphor powder radiates light in the presence of a strong electric field, using very little current.

A modern (post 1980) EL lamp is a thick film device, typically including a transparent substrate of polyester or polycarbonate material having a thickness of about 7.0 mils (0.178 mm.). A transparent, front electrode of indium tin oxide or indium oxide is vacuum deposited onto the substrate to a thickness of 1000 Å or so. A phosphor layer is screen printed over the front electrode and a dielectric layer is screen printed over phosphor layer. A rear electrode is screen printed over the dielectric layer.

Even though screen printing is a well developed technology and, therefore, relatively low in cost, there are disadvantages to screen printing. The resolution of screen printing is not as good as desired. For example, printing a fine line gap, e.g. 0.001" wide, between conductors cannot be done reliably by screen printing adjacent conductors.

There are many applications for EL panels that require complicated patterns, e.g. displays such as instrument panels. Complicated patterns are presently obtained by patterning both the front electrode and the rear electrode of an EL panel and, occasionally, by combining several EL panels into one display. Such construction is costly, particularly because the patterned electrodes must be properly registered in order to produce the desired display.

Although it is desired to find a simple construction for complicated displays, it is preferred to use individual process steps or materials that are known to the art. Any new process is much more easily implemented, and much less expensive to implement, if the individual steps are known and if the materials used are familiar. A process and construction are even more desirable if they are backward compatible with existing products. That is, the new process and construction can be used to make EL panels that replace panels previously made another way. For example, a process that can produce complicated displays does not have to be used only for making complicated displays. The process could be used for making EL panels in which neither electrode is patterned.

It is known in the art to laminate an EL lamp. U.S. Pat. No. 4,560,902 (Kardon) discloses depositing a dielectric film on a sheet of aluminum foil, depositing a phosphor layer on a Mylar® sheet coated with indium tin oxide, and then laminating the two sheets together.

U.S. Pat. No. 5,469,109 (Mori) discloses laminating two coated, transparent sheets together wherein a first sheet includes a transparent electrode, a phosphor layer, and a dielectric layer and a second sheet includes an adhesive layer and a rear electrode overlying the adhesive layer. The adhesive layer is larger than the rear electrode and contacts the first sheet, enclosing the phosphor layer and the dielectric layer to seal the lamp.

In view of the foregoing, it is therefore an object of the invention to provide an EL panel laminated to a rear electrode in which only the rear electrode is patterned.

Another object of the invention is to provide an EL panel laminated to a rear electrode in which neither the front electrode nor the rear electrode is patterned.

A further object of the invention is to provide an EL panel laminated to a rear electrode in which the rear electrode is a metal sheet, a printed circuit board, or a flex circuit.

SUMMARY OF THE INVENTION

The foregoing objects are achieved by the invention in which an EL panel includes lamp materials laminated to a conductive sheet, wherein the lamp materials include a front electrode, a phosphor layer, and a dielectric layer. The conductive sheet is the rear electrode for the EL panel. In accordance with one aspect of the invention, the conductive sheet is metal foil, a layer of a printed circuit board, or a layer on a flex circuit. In accordance with another aspect of the invention, the phosphor layer and the dielectric layer are applied to the front electrode by screen printing or by roll coating.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
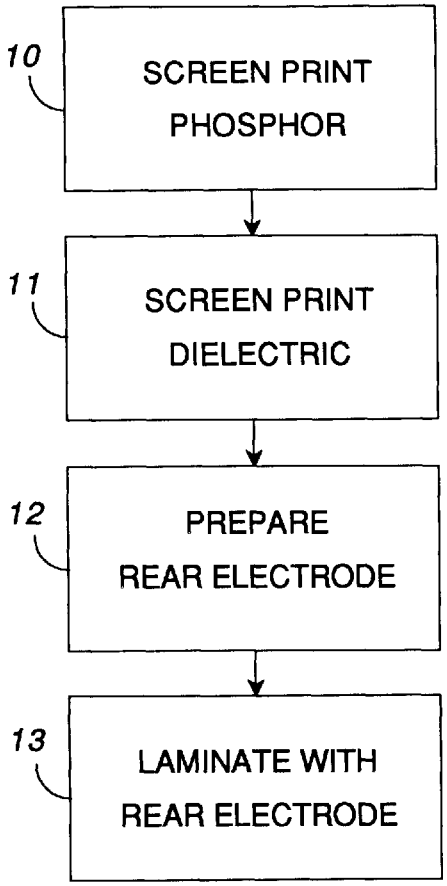
FIG. 1 is a flow chart for making an EL lamp in accordance with one aspect of the invention.

FIG. 1 is a flow chart for making an EL panel by screen printing the layers. The front electrode is a transparent substrate coated with a transparent, conductive film and is commercially available from several sources. Step 10 is screen printing a suitable EL phosphor on the front electrode. Step 11 is screen printing a dielectric layer over the phosphor layer. Thus far, the process is the same as in the prior art and yields a multi-layer structure that is referred to as "lamp materials" herein.

Unlike the prior art, the rear electrode is prepared on a separate substrate, step 12. For example, a printed circuit board having a conductive layer etched in the desired pattern is partially or completely covered by the lamp materials, which are then laminated to the rear electrode, step 13.

The separate substrate, whether it be a metal sheet or foil, a printed circuit board, or a flex circuit, provides a lower resistance rear electrode than is available from conductive inks. Another advantage is that the rear electrode can be patterned with finer lines or gaps than screen printed materials. Finer lines mean that the pattern being displayed can be more intricate. Finer gaps mean that there is less unintended dark space.

The foregoing advantages combine to produce an additional advantage. As is well known, an EL lamp is luminous only where there is luminescent material between two electrodes. The interconnects between luminous areas are luminous unless the opposite electrode is patterned to remove electrode material from over the interconnects. Lower resistance and fine line geometry mean that the interconnects can be smaller, and less visible, than in the prior art. If a multi-layer printed circuit board is used as the separate substrate, then the interconnects can be made essentially invisible, i.e. significantly dimmer than the areas intended to be luminous, by including the interconnect in the printed circuit layer furthest from the phosphor layer.

A further advantage of the separate substrate is that the circuitry on the substrate can be much more complex to provide a selectively activated display. That is, there can be more interconnects and more complex arrangements of luminous areas and the luminous areas can be activated in any sequence or pattern.

Figure 2:
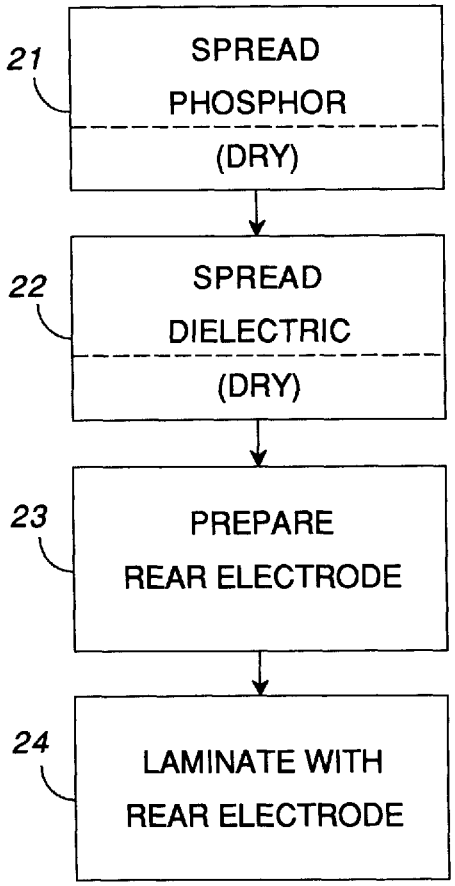
FIG. 2 is a flow chart for making an EL lamp in accordance with another aspect of the invention.

FIG. 2 is a flow chart for making an EL panel by roll coating the lamp materials. The principles of roll coating are known in the art. "Roll coating" is a generic term for the process and apparatus in which a liquid is spread over a surface, e.g. a blade over a flat plate, a blade over a roller, gravure, flexography, air knife, and reverse rolls, among others.

In step 21 a suitable EL phosphor is roll coated onto the front electrode. In step 22, a dielectric layer is roll coated on the phosphor layer. The rear electrode is prepared as a separate substrate, step 23, and the previously prepared lamp materials are then laminated to the rear electrode, step 24.

Screen printing (FIG. 1) enables one to print phosphors of different colors in different areas in consecutive printings. Roll coating (FIG. 2) enables one to produce large areas of material at low cost. Lamps made from roll coated material also exhibit slightly less graininess than lamps made by screen printing. All other advantages obtained from the process illustrated in FIG. 1 are also obtained from the process illustrated in FIG. 2.

Figure 3:
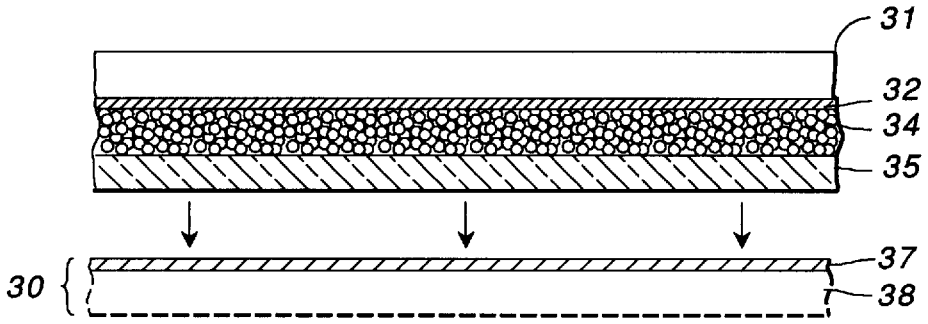
FIG. 3 illustrates laminating the lamp materials to a rear electrode.

FIG. 3 illustrates step 13 (FIG. 1) in which lamp materials are laminated to the rear electrode. The lamp materials include transparent substrate 31, transparent electrode or front electrode 32, phosphor layer 34, and dielectric layer 35. Rear electrode 30 includes conductive layer 37 and optionally includes substrate 38. In one embodiment of the invention, layer 37 is a sheet of metal such as aluminum foil. In another embodiment of the invention, rear electrode 30 includes substrate 38, which can be rigid, as in a printed circuit board, or flexible, as in a flex-circuit.

Conductive layer 37 is patterned optically, mechanically, or chemically. If the rear electrode includes only conductive layer 37, the amount of patterning is limited by the integrity of the rear electrode. That is, dimensional stability must be maintained. Conductive layer 37 is preferably copper for printed circuit boards and flex circuits and aluminum for metal sheet or foil. Other conductive materials and alloys can be used instead.

The lamp materials and the rear electrode are squeezed together between hot rollers under a predetermined pressure and temperature sufficient to cause the binder in the dielectric layer to adhere to the rear electrode; e.g. at 180° C. and 5–30 psi. The binder in the dielectric layer acts as a thermal adhesive by softening and adhering to the printed circuit board. The temperature and pressure depend upon the material used for the binder in the dielectric layer and are readily determined empirically.

Figure 4:
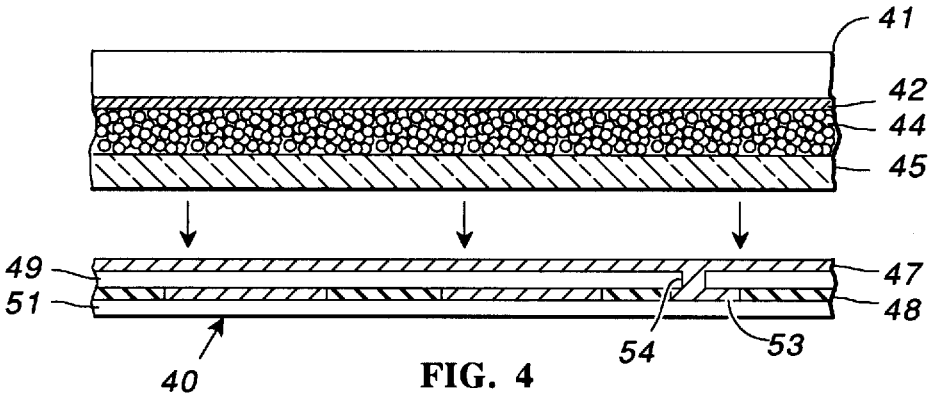
FIG. 4 illustrates laminating the lamp materials to a multi-layer, printed circuit board.

FIG. 4 illustrates step 13 (FIG. 1) in which lamp materials are laminated to a multi-layer printed circuit board. The lamp materials include transparent substrate 41, transparent electrode or front electrode 42, phosphor layer 44, and dielectric layer 45. Rear electrode 40 is a multi-layer sandwich including conductive layer 47 and conductive layer 48 separated by insulating layer 49 and overlying insulating layer 51. A luminous area controlled by conductive layer 47 is connected to other luminous areas by bus 53 extending into the plane of the drawing. Layer 47 is connected to bus 53 by conductor 54, which is a plated-through hole or a solid conductor. Preferably, layer 47 is patterned to produce a plurality of images and layer 48 is patterned to interconnect the images in the desired grouping. Connections to the lamps in a panel are thus simplified because the connections can be arranged in more than one plane.

The invention thus provides an EL panel laminated to a rear electrode in which only the rear electrode is patterned. Alternatively, neither the front electrode nor the rear electrode is patterned. The rear electrode is a metal sheet or foil, a printed circuit board, or a flex circuit.

Having thus described the invention, it will be apparent to those of skill in the art that various modifications can be made within the scope of the invention. For example, a separate adhesive layer can be used for adhesion instead of the dielectric layer. A hot platen laminator can be used instead of heated rollers. The bond between the dielectric layer and bare metal can be enhanced by treating the metal with an adhesion promoter, e.g. "silane." The adhesion promoter commonly referred to as "silane" is not $SiH_4$ (a gas) but a siloxane (a liquid), such as N-(2-aminoethyl)-3-aminopropyl-trimethoxysilane. Several other adhesion promoters are commercially available.

What is claimed as the invention is:

1. An EL panel comprising:

a printed circuit board having at least one patterned, conductive layer;

lamp materials laminated to said printed circuit board, wherein said lamp materials include a front electrode and a phosphor layer;

wherein said patterned, conductive layer defines-the rear electrodes) for a plurality of lamps in said EL panel and includes a plurality of traces for interconnecting the lamps in said panel.

2. An EL panel as set forth in claim 1 wherein said printed circuit board includes a plurality of conductive layers and the rear electrodes are in a first conductive layer and the traces are part of another conductive layer.

3. An EL panel as set forth in claim 2 wherein the rear electrodes are immediately adjacent said lamp materials and said traces are separated from said lamp materials, thereby reducing the luminosity of interconnects when the lamps are luminous.

4. An EL panel comprising:

a flex circuit having at least one patterned, conductive layer;

lamp materials laminated to said flex circuit, wherein said lamp materials include a front electrode and a phosphor layer;

wherein said patterned, conductive layer defines the rear electrodes for a plurality of lamps in said EL panel and includes a plurality of traces for interconnecting the lamps in said panel.

5. An EL panel as set forth in claim 1 wherein said flex circuit includes a plurality of conductive layers and the rear electrodes are in a first conductive layer and the traces are part of another conductive layer.

* * * * *